US012637866B2

(12) United States Patent
Skelton et al.

(10) Patent No.: US 12,637,866 B2
(45) Date of Patent: May 26, 2026

(54) TOE BOARD FOR SCAFFOLDING

(71) Applicant: Applied Laser Technologies, LLC, Schofield, WI (US)

(72) Inventors: Rodney Michael Scott Skelton, Sherwood Park AB (CA); Chris Osswald, Rothschild, WI (US); Jonah Higgs, Wausau, WI (US); Jeremy Falkowski, Wittenberg, WI (US); Archie Troy Lumsden, Rock Hill, SC (US); Troy Kowalski, Spruce Grove (CA)

(73) Assignee: ADELIE, LLC, Depere, WI (US)

( * ) Notice: Subject to any disclaimer, the term of this patent is extended or adjusted under 35 U.S.C. 154(b) by 1460 days.

(21) Appl. No.: 16/953,557

(22) Filed: Nov. 20, 2020

(65) Prior Publication Data

US 2022/0162864 A1 May 26, 2022

(51) Int. Cl.
*E04G 5/14* (2006.01)
*E04G 7/28* (2006.01)

(52) U.S. Cl.
CPC ..... *E04G 5/145* (2013.01); *E04G 7/28* (2013.01); *E04G 2007/285* (2013.01)

(58) Field of Classification Search
CPC .. E04G 5/14; E04G 5/145; E04G 7/28; E04G 2007/285; F16L 3/02; F16L 3/243; F16L 3/24
USPC ..... 182/113; 248/220.22
See application file for complete search history.

(56) References Cited

U.S. PATENT DOCUMENTS 165,206 A * 7/1875 Brown ..... A47G 1/16 248/216.1
2,136,696 A * 11/1938 Lamb ..... E04G 5/06 182/113
3,226,065 A * 12/1965 Smith ..... A47G 1/22 D8/367
3,501,117 A * 3/1970 Soltysik ..... F16L 3/221 24/339
3,536,281 A * 10/1970 Attore ..... F16L 3/24 24/339
3,684,230 A * 8/1972 Swanquist ..... H02G 3/125 220/3.9
3,720,395 A * 3/1973 Schuplin ..... H02G 3/126 220/3.9

(Continued)

FOREIGN PATENT DOCUMENTS

EP 0338462 B1 6/1993
JP 2004176310 A1 6/2004

OTHER PUBLICATIONS

GSD International, L.P., Part No. Grustbxx, Universal Toe Board specification Dated Apr. 26, 2011.

(Continued)

*Primary Examiner* — Colleen M Chavchavadze
*Assistant Examiner* — Shiref M Mekhaeil
(74) *Attorney, Agent, or Firm* — Bradley J. Thorson; DeWitt LLP

(57) ABSTRACT

A scaffolding toe board system comprising a plurality of toe boards constructed of a panel and a pair of brackets used to couple the ends of the panel to adjacent support posts of the scaffolding. The brackets are all identical, and designed so that the brackets of two toe boards coupled to the same support post will not interfere with each other.

18 Claims, 9 Drawing Sheets

(56) References Cited

U.S. PATENT DOCUMENTS 3,782,499 A * 1/1974 Fisher ..... E04G 5/00 182/230
3,785,602 A * 1/1974 Juculano ..... F16B 2/248 182/113
3,851,858 A * 12/1974 Komiske ..... E04G 7/28 52/288.1
3,853,203 A * 12/1974 Werner ..... E04G 5/14 182/113
3,936,024 A * 2/1976 Jung ..... H02G 3/0437 211/193
4,113,109 A * 9/1978 Donnelli ..... B65D 77/22 211/49.1
4,333,625 A * 6/1982 Haug ..... A47G 1/20 248/216.1
4,458,387 A * 7/1984 Pearson ..... A47C 31/02 411/442
5,139,080 A * 8/1992 Bolton ..... F28F 9/002 248/225.11
5,588,166 A * 12/1996 Burnett ..... F16L 3/1075 5/503.1
5,810,303 A * 9/1998 Bourassa ..... H02G 3/126 248/300
5,896,721 A * 4/1999 Sugiyama ..... F16B 9/058 52/712
6,112,854 A * 9/2000 Davis ..... E04G 5/14 248/295.11
6,354,543 B1 * 3/2002 Paske ..... F16L 3/12 248/68.1
6,489,566 B1 * 12/2002 Durin ..... H02G 3/263 52/712
6,691,767 B2 * 2/2004 Southwick ..... B60K 11/04 180/68.4
6,976,557 B2 * 12/2005 Becker ..... E04G 5/14 182/113
7,407,240 B2 * 8/2008 Collins ..... F25D 23/069 312/407
7,926,771 B2 * 4/2011 DeMartine ..... F16M 11/10 248/229.23
7,963,367 B2 * 6/2011 Wilson ..... E04G 7/28 256/65.01
8,403,289 B1 * 3/2013 Rinderer ..... H02G 3/126 220/3.9
8,973,707 B2 * 3/2015 Kreller ..... E04G 7/28 182/112
9,051,746 B2 * 6/2015 Rogers ..... E04G 5/08
9,559,504 B2 * 1/2017 Jones ..... H02G 3/12
9,574,589 B2 * 2/2017 Knutson ..... F16M 13/027
10,084,296 B2 * 9/2018 Korcz ..... H02G 3/123
10,197,217 B2 * 2/2019 Will ..... A47G 1/16
10,539,266 B2 * 1/2020 Will ..... B43L 1/00
10,724,677 B2 * 7/2020 Will ..... F16M 13/02
11,149,431 B1 * 10/2021 Meznarich ..... E04B 7/022
11,199,011 B2 * 12/2021 Kreller ..... E04G 5/145
11,473,721 B2 * 10/2022 Oh ..... H02G 3/0456
11,486,424 B2 * 11/2022 Hunt ..... F16B 2/245
11,725,385 B2 * 8/2023 Mosiadz ..... E04B 9/366 52/506.06
2005/0189173 A1 * 9/2005 Becker ..... E04G 5/141 182/113
2007/0145222 A1 * 6/2007 Rausch ..... F24F 13/0254 248/317
2007/0278042 A1 * 12/2007 Wilson ..... E04G 7/28 182/113
2008/0099641 A1 * 5/2008 Best ..... F01P 3/18 248/220.22
2010/0000783 A1 * 1/2010 Tally ..... H02G 1/00 174/505
2010/0176138 A1 * 7/2010 Zacharevitz ..... H02G 1/00 220/737
2013/0015015 A1 * 1/2013 Pedicone, Jr. ..... E04G 7/28 182/113
2015/0333493 A1 * 11/2015 Jones ..... H02G 1/00 174/480
2018/0017189 A1 * 1/2018 Wegner ..... F16L 3/2431
2019/0285224 A1 * 9/2019 McKechnie ..... F16M 11/18
2020/0048917 A1 * 2/2020 Kreller ..... E04G 7/28
2022/0049510 A1 * 2/2022 Charitou ..... E04G 17/002

OTHER PUBLICATIONS

DSS, DSS Adjustable Toe Boards assembly instructions, dated Jan. 19, 2018, 4 pages.

Canadian Intellectual Property Office, Examination report dated Feb. 22, 2023 for corresponding Canadian Application No. 3,139,413, 10 pages.

* cited by examiner

TOE BOARD FOR SCAFFOLDING

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

This invention relates to scaffolding systems. More specifically, the present invention relates to toe boards used to protect (a) workers from over-stepping the edges of a scaffolding platform, and (b) those adjacent to and below a scaffolding platform from injuries that might result from objects sliding off the edges of a scaffolding platform.

II. Discussion of the Prior Art

Scaffolding systems are employed to provide a safe, raised working surface for carrying out construction, maintenance, and repair activities. Scaffolding systems typically comprise a frame made of rails and connectors that support one or more platforms at designated heights above a floor or the ground. Workers stand, kneel or sit on such platforms to perform construction, maintenance and repair functions.

Safety is a major concern at all construction sites. It is well understood that workers can accidently step off the platform. It is also well understood that workers, or even pedestrians, standing or walking near scaffolding may be injured by objects falling from the platform.

A common solution to prevent workers from inadvertently stepping off a scaffolding platform and objects from falling from the platform is to provide toe boards about the periphery of the platform. Such toe boards are shown and described in U.S. Pat. No. 3,782,499 granted to Fisher on Jan. 1, 1974, U.S. Pat. No. 6,112,854 granted to Davis on Sep. 5, 2000, U.S. Pat. No. 6,976,557 to Becker on Dec. 20, 2005, and U.S. Pat. No. 8,973,707 granted to Kreller on Mar. 10, 2015.

While safety is a major concern when performing construction, maintenance and repair services, so is efficiency. This is because bidding is a common practice and contracts for services are often awarded to the lowest responsive bidder. The more efficiently one can be to complete a project, the lower the price one can bid and still earn a reasonable profit.

Some projects are so large that erection and dismantling of scaffolding is often bid separately from other work performed to complete the project. As such, the contractor awarded the scaffolding project may be different than the contractor(s) involved in performing the actual construction, maintenance, or repair. Even when this is not the case, whoever is responsible for erection of the scaffolding needs to be efficient.

There is an ongoing need to improve scaffolding systems not only to address safety concerns when in use, but also to enable expeditious assembly and dismantling of scaffolding systems. As such, considerable effort has been directed toward designing components for scaffolding systems to achieve improved safety and improved efficiency with respect to assembly and disassembly of scaffolding systems.

Efficiency is particularly important when it comes to the installation and removal of toe boards. While toe boards represent an important safety feature, they are not necessary, as are the frames and platforms of a scaffolding system, to complete the project. They are often not installed when they should be because, heretofore, doing so has been both relatively difficult and time consuming. As such, there currently exists a need in the marketplace for a toe board and toe board latch design that enables efficient assembly and disassembly of the scaffolding systems while providing the safety benefits offered by toe boards.

SUMMARY OF THE INVENTION

Safety, efficiency, ease of assembly and cost effectiveness are all enhanced by providing scaffolding toe board assemblies, each comprising a toe board and a pair of brackets, each bracket of the same design, that can be quickly deployed to attach the two ends of the toe board to two support posts of a scaffolding assembly.

Such toe boards have a planer panel with an inside surface and an outside surface. Engagement slots extending through the planar panel. Depending on the design of the brackets employed, a single engagement slot or multiple engagement slots may be present adjacent each of the first end and the second end of the planar panel. For improved rigidity, a reinforcing lip may be provided that is integrally formed with and projects from a top edge of the panel. A support lip projecting from a bottom edge of the panel may also be provided. This support lip will typically extend in face-to-face registration with the top surface of a scaffolding platform when the panel is installed. The panel may be constructed of any suitable material including metals such as steel or aluminum, or plastics such as polyethylene or polyvinyl chloride.

Ideally, the brackets employed will all be of the same design. Two such brackets are required to couple a toe board to two adjacent support posts of the scaffolding assembly. The brackets are preferably formed as a single piece integrated unit. The brackets may be constructed of any suitable material including metals such as steel or aluminum, or plastics such as polyethylene or polyvinyl chloride.

Each bracket typically includes a plate extending along a first plane. The plate has a first edge and a second edge parallel to the first edge. The first edge extends from a first corner to a second corner. The first edge also has a midpoint, a first arm attachment portion extending from the first corner to the midpoint, and second arm attachment portion extending from the midpoint to the second corner.

Each bracket typically includes a support post receiving channel assembly extending outwardly from the first edge. The support post receiving channel assembly has two arms, more specifically, a first arm extending from the first arm attachment portion and second arm extending from the second arm attachment portion. The support post receiving channel assembly adapted to receive and engage a support post of a scaffolding assembly between the first arm and the second arm.

In some embodiments, one of these arms is a flat arm and the other of these arms is a bent arm. The flat arm extends outwardly from the first arm attachment portion of the first edge of the plate along the same plane as the plate. The bent arm has a first arm portion extending from the second arm attachment portion of the first edge of the plate at a first angle. This first angle may be ninety degrees such that the first arm portion extends in a direction normal to the plane along which the plate extends. The bent arm also has a second arm portion. This second arm portion extends outwardly from the first arm portion at a second angle. This second angle may also be ninety degrees such that the second arm portion extends in a direction normal to first arm portion and parallel to the plane along which the plate and flat arm extend. In these embodiments, the support post receiving channel assembly is adapted to receive and engage a support post of a scaffolding assembly between the flat arm and the second arm portion of the bent arm. More specifically, the flat arm extends along a first side of the support post and the second arm portion of the bent arm extends along a second side of a scaffolding support post when the toe board assembly is in use.

The angles of the bent arm may, of course, be altered without deviating from the invention. For example, the flat arm and the second arm portion of the bent arm will still extend parallel to each other if the first angle of the bent arm is forty-five degrees and the second angle of the bent arm is one hundred thirty-five degrees. Further, it is not necessary that the flat arm and second arm portion of the bent arm be parallel to each other, or that the bent arm have two or more distinct angles. The bent arm could be curved as opposed to angled.

What is important is that the arms of support post receiving channel assembly of the brackets be formed so that they can sufficiently capture a scaffolding post to prevent inadvertent dislodgement of the bracket from the post, while at the same time permitting the post to be easily coupled and decoupled from the bracket when desired. Also important is that the arms of the brackets are designed so that two toe board assemblies may be assembled ninety degrees from each other to the same scaffolding support post without the arms of the bracket of one such toe board assembly interfering with the placement or operation of the bracket of the other toe board assembly.

Each bracket typically also includes a hook adapted to receive and engage the first end of the planar panel. The hook has a first portion extending from the inside surface of the plate and a second portion spaced from and extending from the first portion parallel to the inside surface of the plate.

Each bracket also includes one or more legs extending from the second edge of the plate. The number of legs typically matches the number of engagement slots present adjacent either the first end or the second end of the planar panel. Each leg comprises a first transition and a first foot extending from the first transition along a second plane parallel to the first plane along which the plate extends. Each foot is adapted to pass through an engagement slot and each transition is adapted to reside within the engagement slot.

Given this construction of the brackets and toe boards, a first bracket is adapted to be coupled to a first end of the toe board by passing the foot of each leg of the first bracket through an engagement slot adjacent the first end of the toe board so that the foot of the leg engage the inside surface of the panel, the transition of the leg resides within the engagement slot, the plate engages the outside surface of the panel, and the hook engages the first end of the panel. Likewise, a second bracket may be coupled to the second end to the toe board by passing the foot of each leg of the second bracket through an engagement slot adjacent the second end of the toe board so that the foot of the leg engages the inside surface of the panel, the transition of the leg resides within the engagement slot, the plate engages the outside surface of the panel, and the hook engages the first end of the panel. Once the two brackets are so attached, the channel members may be coupled to adjacent posts of the scaffolding assembly and the assembly of the toe boards and two brackets may be slid into position so that the bottom of the panel rests on top of a scaffolding platform with the panel extending in an upward direction generally perpendicular to the top of the platform.

Additional toe board assemblies can be assembled in this same way and coupled to the support posts of the scaffolding in this same fashion to protect as many sides of a scaffolding platform as deemed advisable. The channel members of two toe board assemblies coupled to the same support post will not interfere with each other if both brackets are constructed and installed as described above.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
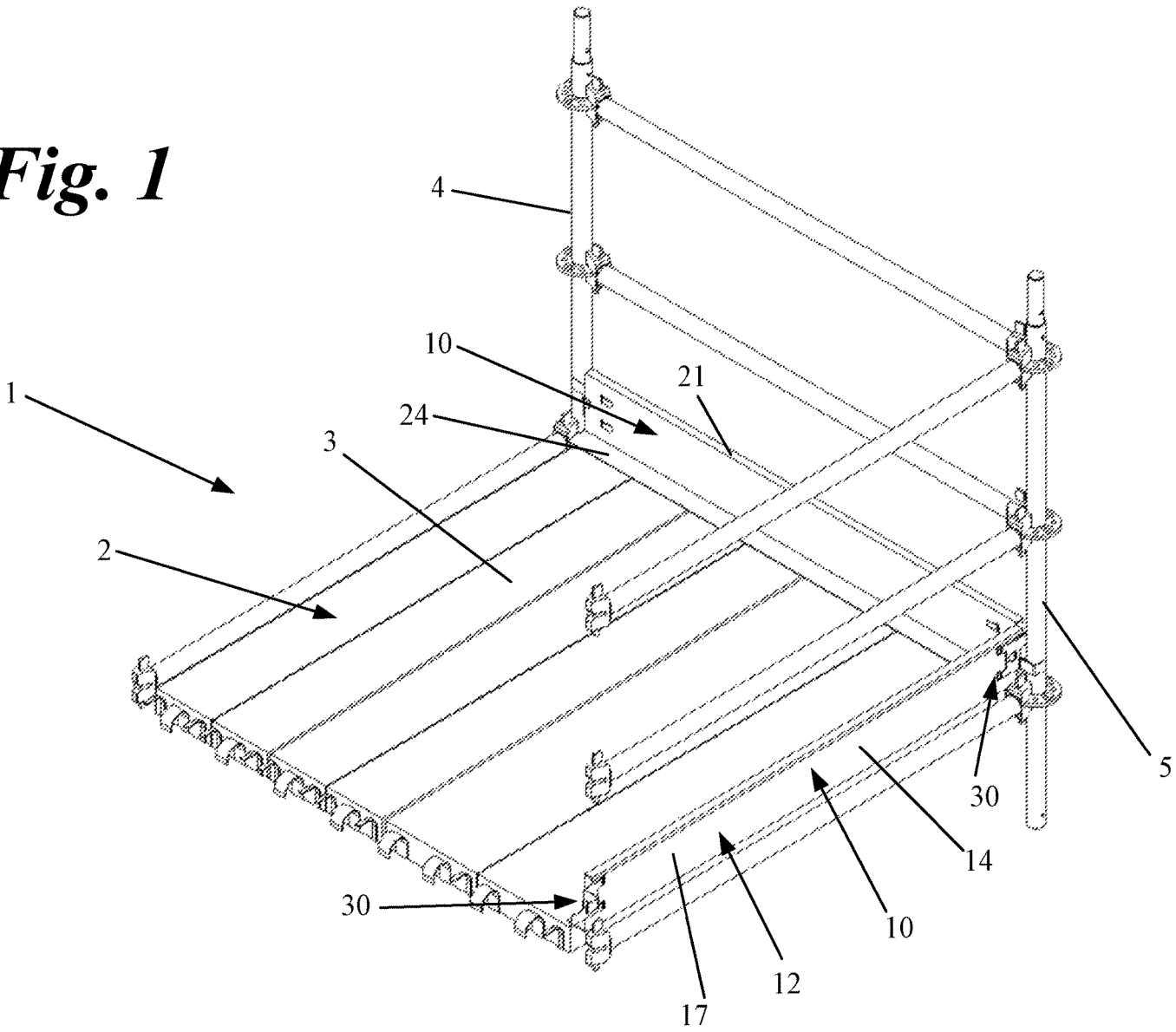
FIG. 1 is a first perspective view showing a portion of a scaffolding system equipped with toe board assemblies made in accordance with the present invention.
Figure 2:
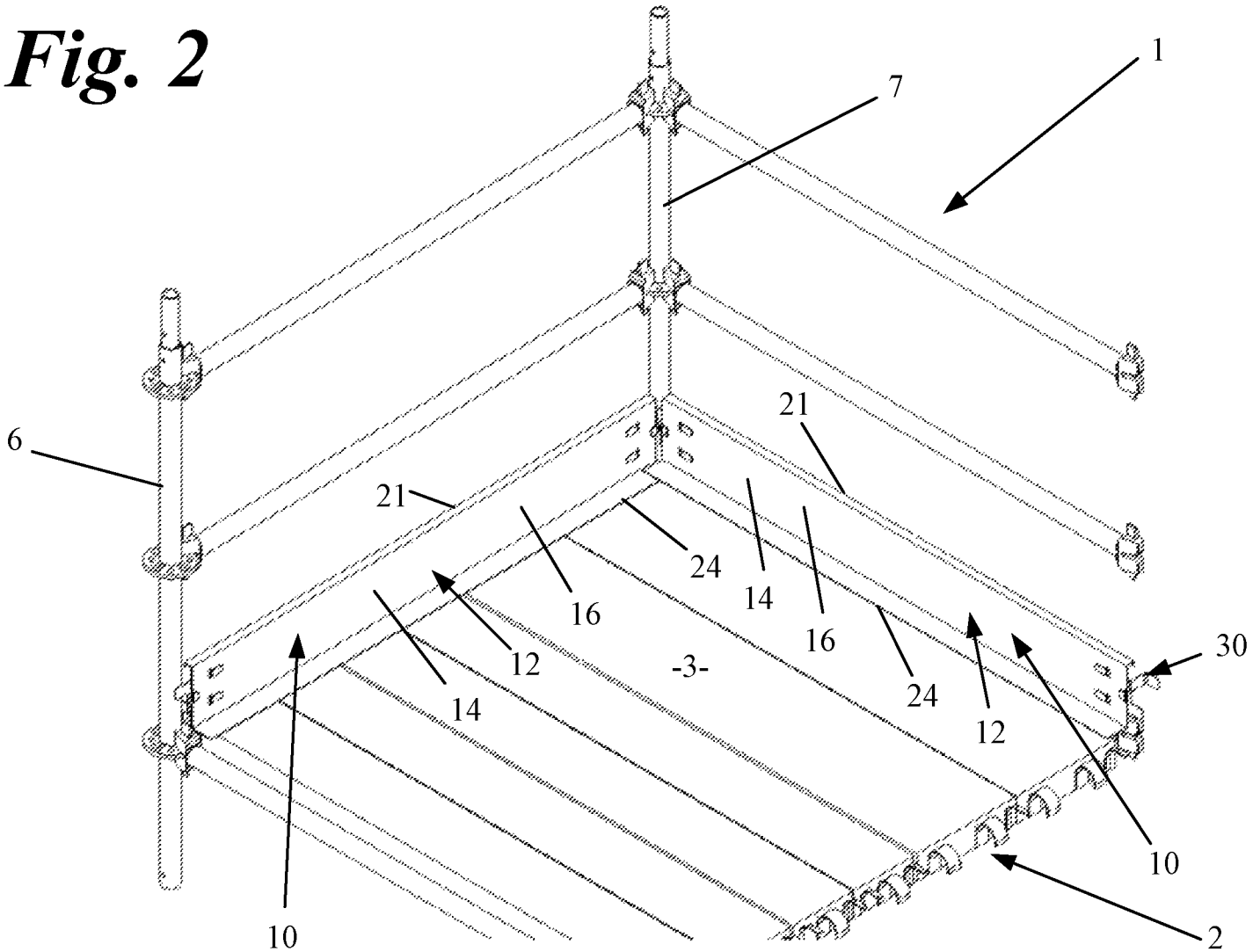
FIG. 2 is a second perspective view showing a portion of a scaffolding system equipped with toe board assemblies made in accordance with the present invention.
Figure 3:
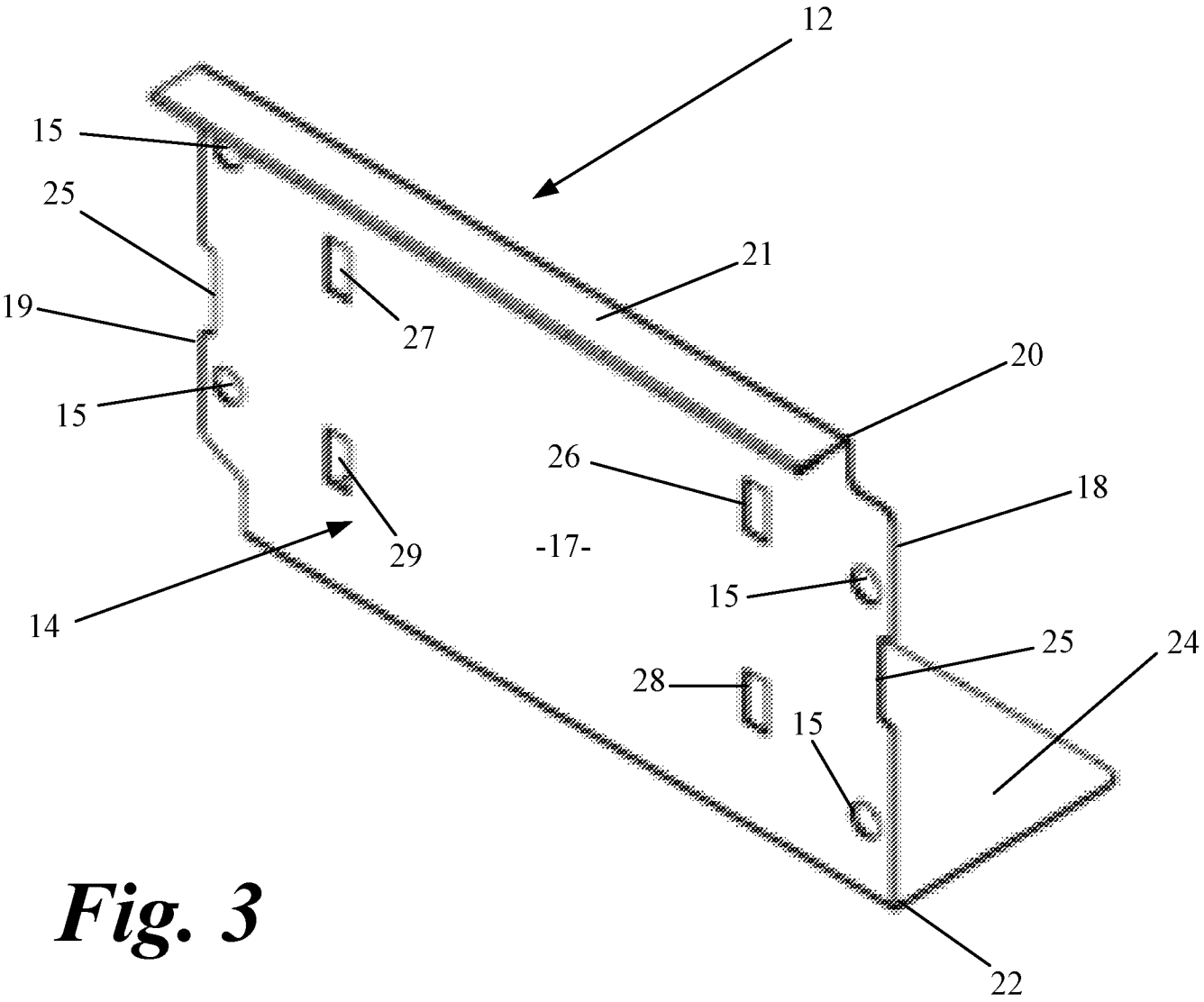
FIG. 3 is a perspective view of a toe board of a toe board assembly made in accordance with the present invention.
Figure 4:
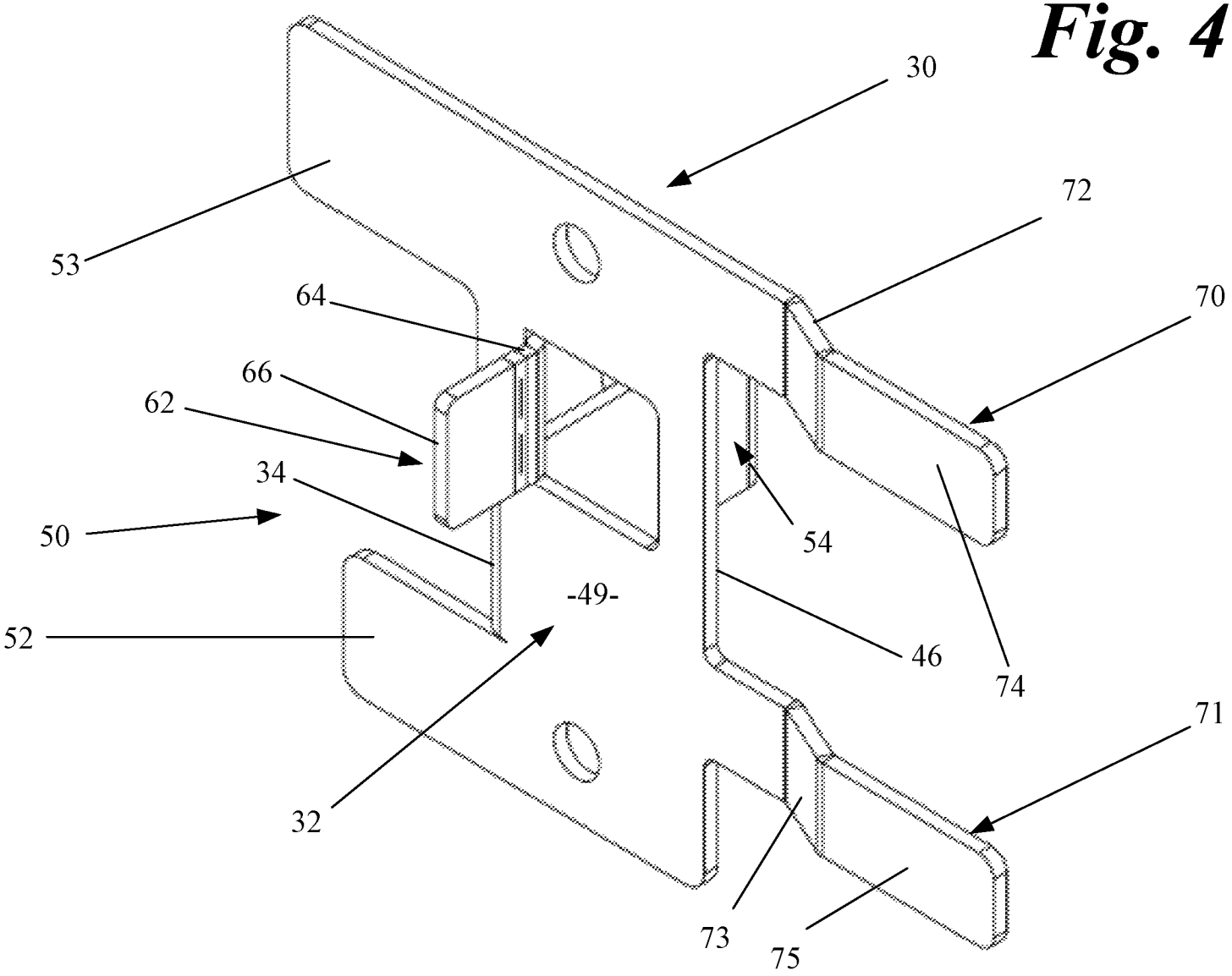
FIG. 4 is a perspective view of a bracket of a toe board assembly made in accordance with the present invention.
Figure 5:
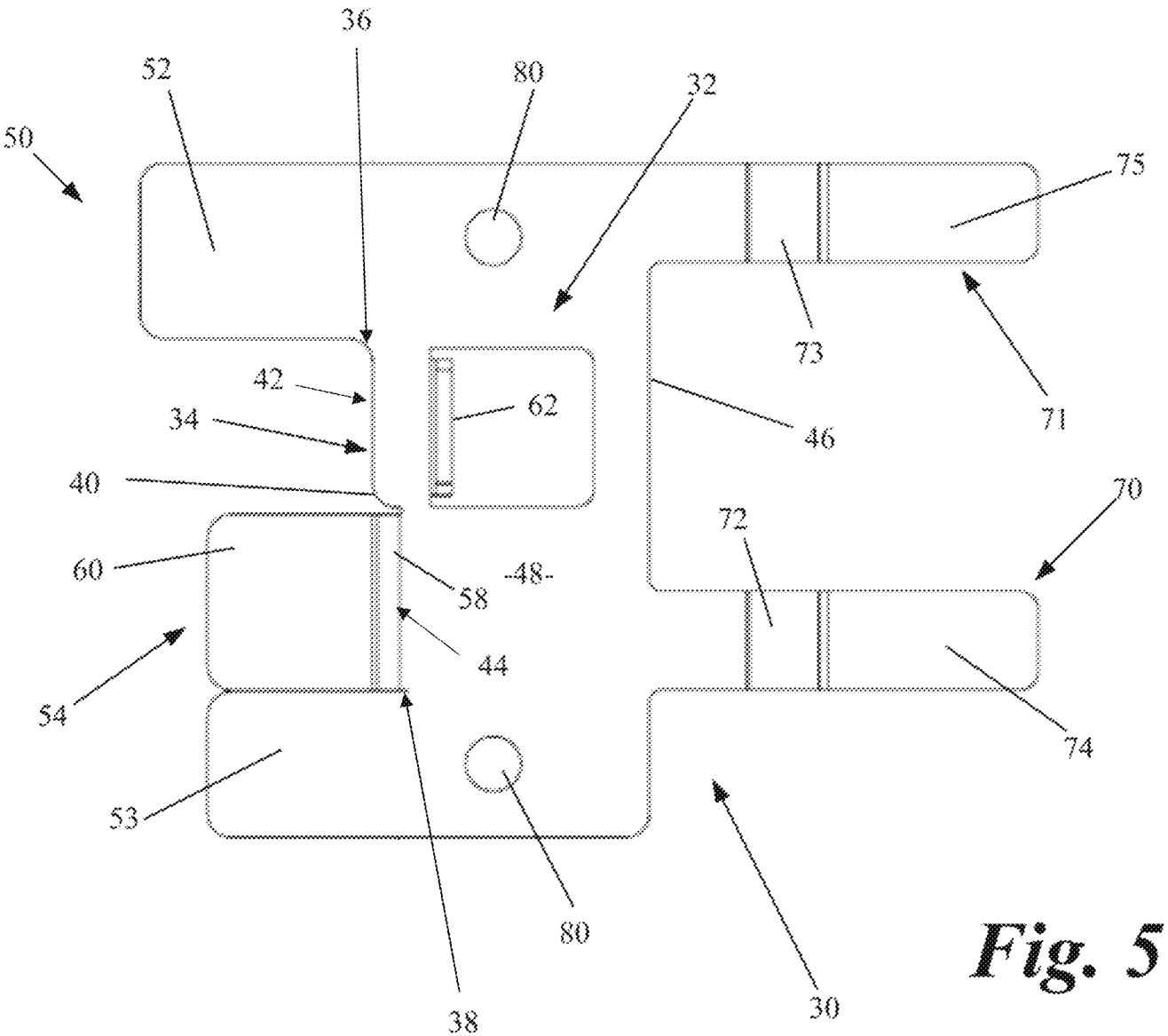
FIG. 5 is a front plan view of the bracket of FIG. 4.
Figure 6:
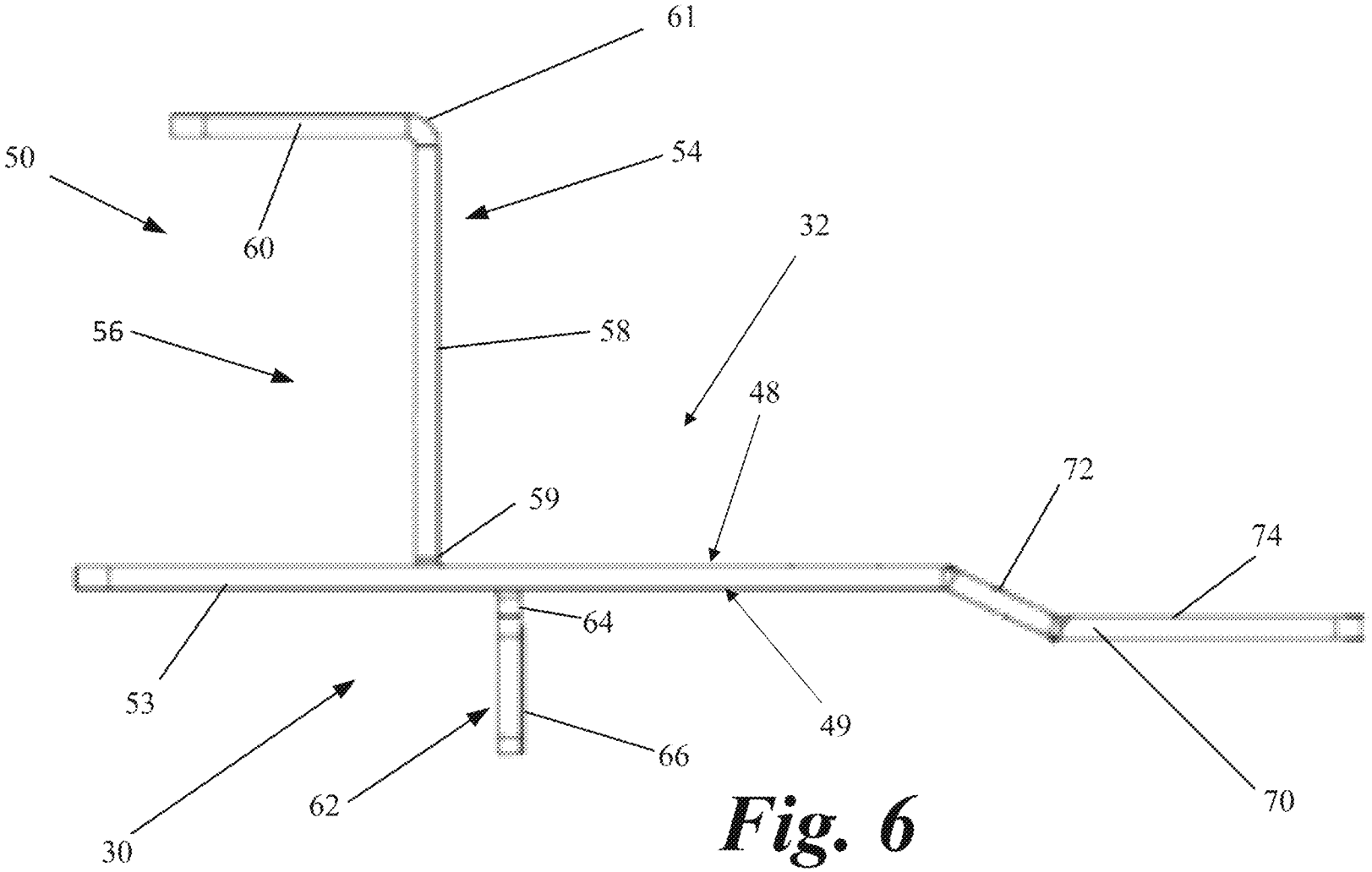
FIG. 6 is a side view of the bracket of FIG. 4.
Figure 7:
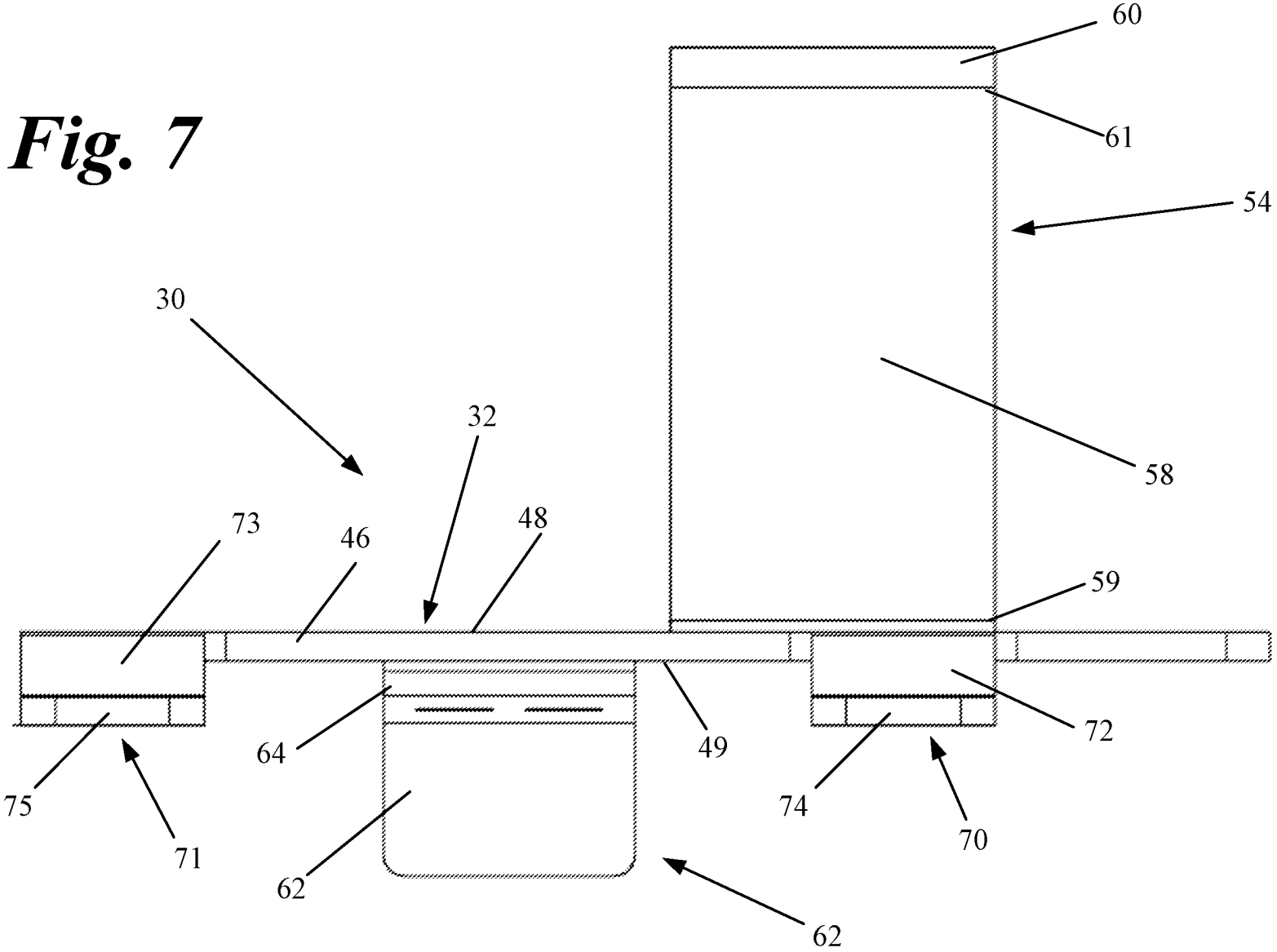
FIG. 7 is an end view of the bracket of FIG. 4.
Figure 8:
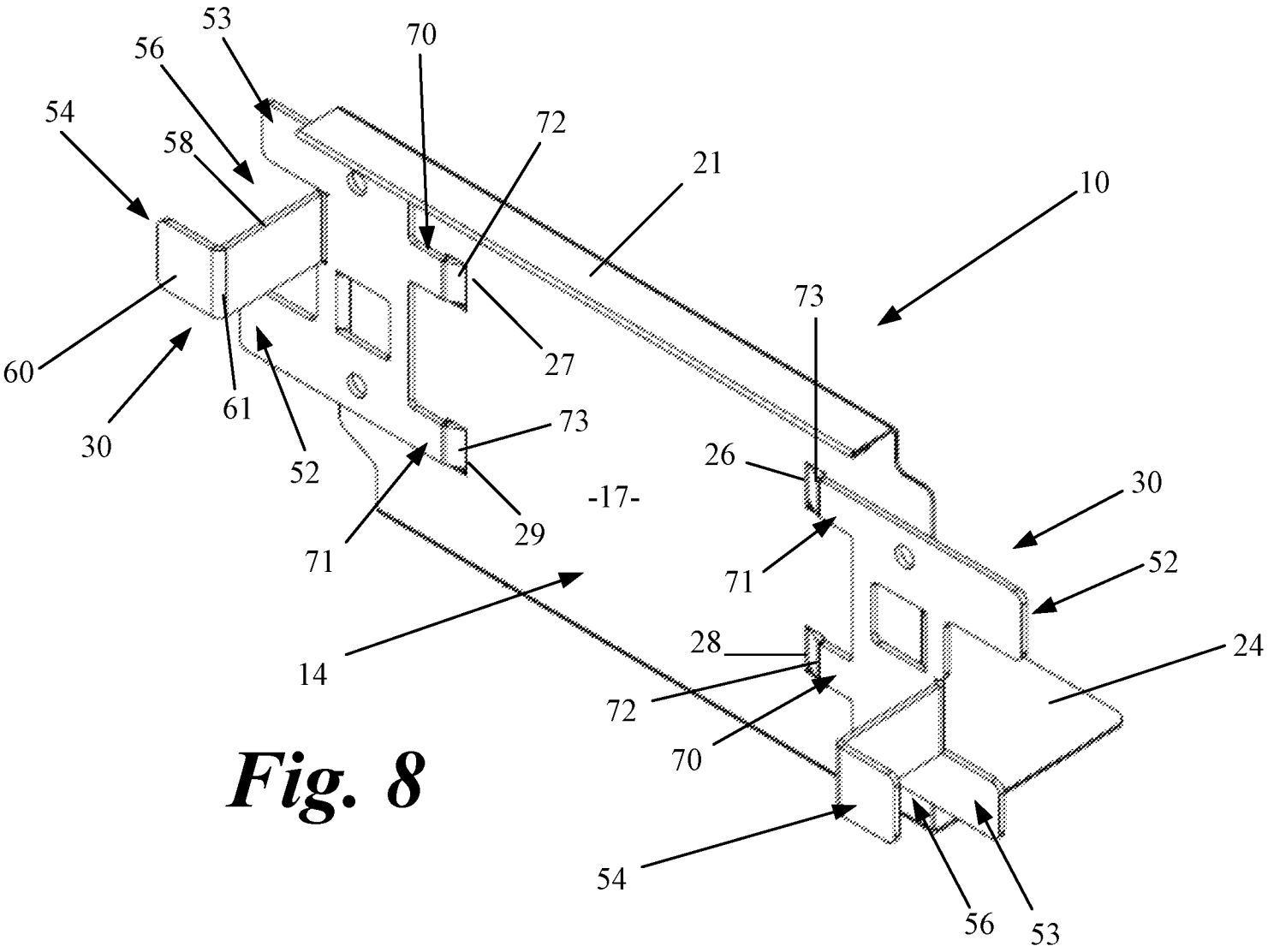
FIG. 8 is a first perspective view showing a pair of brackets coupled to a toe board, all made and assembled in accordance with the present invention.
Figure 9:
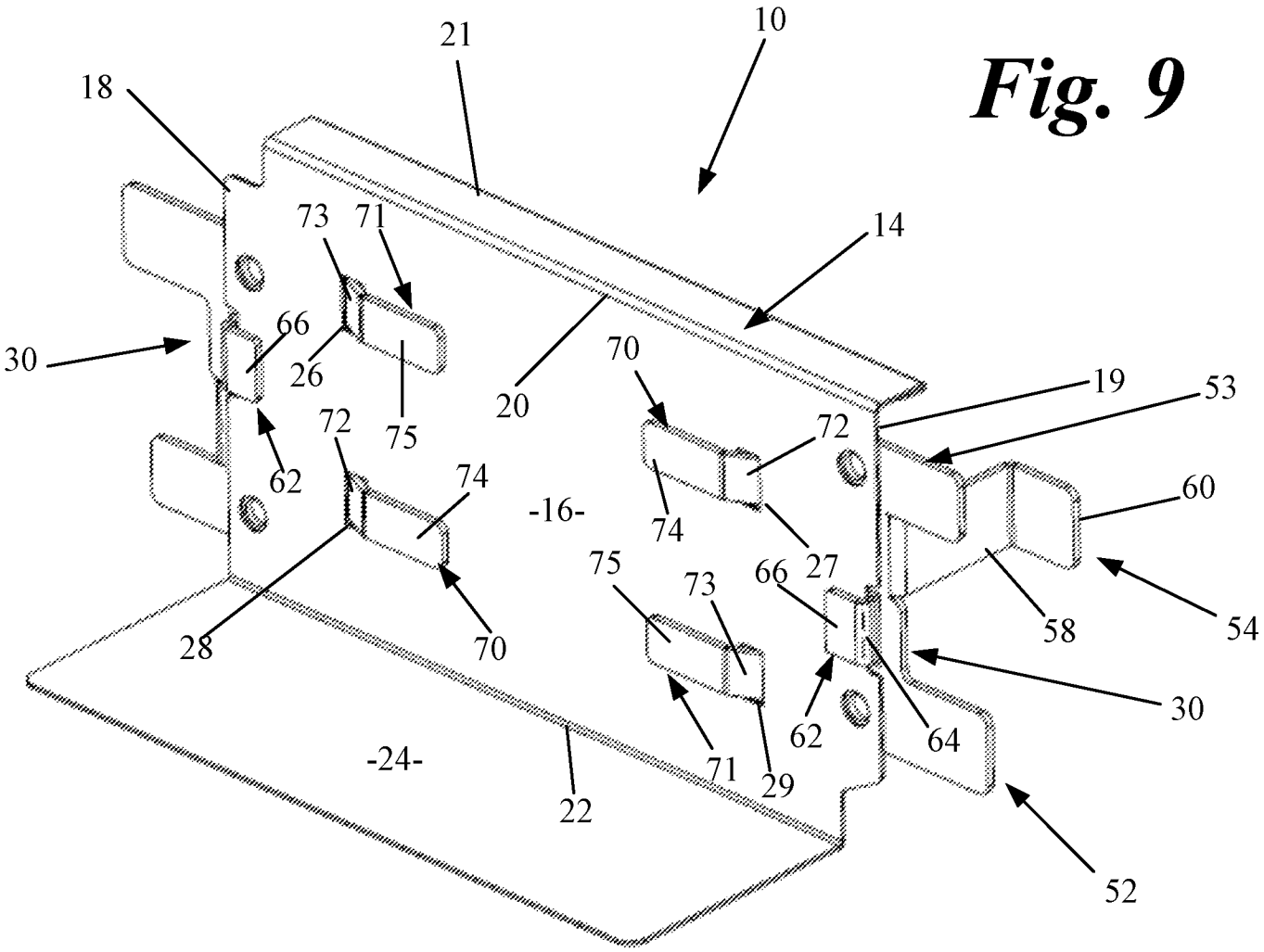
FIG. 9 is a second perspective view showing a pair of brackets coupled to a toe board, all made and assembled in accordance with the present invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Scaffolding assemblies, like scaffolding assembly 1, are commonly used is to enable workers to carry out their duties at elevated heights well above the floor or ground. Such scaffolding assemblies typically include one or more work platforms 2 having a top surface 3 upon which workers and equipment may be positioned. The platforms 2 are typically supported by a plurality of scaffolding support posts such as posts 4-7 shown in the drawings.

Scaffolding assemblies typically include railings and sometimes include toe boards. The toe boards are intended to perform at least two safety functions. One is to prevent objects, such as parts, equipment, tools or the like, from sliding or rolling off the platform which could result in damage to the object or to the floor below, or serious injury to workers or even pedestrians standing adjacent to the scaffolding assembly 1. Another is to prevent a worker from stepping off an edge of the platform 2.

A plurality of improved scaffolding toe board assemblies, such as the toe board assembly 10 illustrated in the drawings, is intended to be attached as necessary to the posts 4-7 of the scaffolding system 1 to provide the functions described above. Each toe board assembly 10 is designed to be attached to two adjacent posts. For example, a first toe board assembly 10 may be attached to posts 4 and 5, a second toe board assembly 10 may be attached to posts 5 and 6, a third toe board assembly 10 may be attached to posts 6 and 7, and a fourth toe board assembly 10 may be attached to posts 7 and 4 of the scaffolding assembly 1. The inventions disclosed herein make it possible to quickly, easily and efficiently attach toe board assemblies to the posts in this manner prior to use of the scaffolding assembly 1, and also to quickly, easily and efficiently detach toe board assemblies from the posts as the scaffolding assembly 1 is being disassembled after use.

Each toe board assembly 10 comprises a toe board 12. The toe board 12 comprises a panel 14 having an inside surface 16, an outside surface 17, a first end 18, a second end 19, a top edge 20 having a top reenforcing lip 21, and a bottom edge 22 having a bottom support lip 24. Typically, the top reinforcing lip 21 will extend along the top edge 20 outwardly from the outside surface 17 of the panel 14. Also, the bottom support lip 24 will typically extend along the bottom edge 22 inwardly from inside surface 16 of the panel 14. When toe board assembly 10 is installed, the bottom support lip 24 will typically be in face-to-face registration and contact with the top surface 3 of a platform 2.

A significant feature of the toe board 12 is the engagement slot(s) which extend through the panel 14. Four such engagement slots 26-29 are shown in the drawings. Engagement slots 26 and 28 are arranged adjacent to the first end 18 of the panel 14. Engagement slots 27 and 29 are arranged adjacent to the second end 19 of the panel 14. The number of engagement slots may vary. For example, there may only be two engagement slots, one adjacent first end 18 and another adjacent second end 19. Also, more than two engagement slots may be arranged adjacent each end 18 and 19 of the panel 14. The number of engagement slots provided adjacent each end of the panel will depend on the specific design of the brackets employed to couple the ends of the panel 14 to two adjacent posts of the scaffolding assembly 1.

In addition to the engagement slots, the panel 14 may be provided with a pair of holes 15 associated with the two ends 18 and 19 of the panel 14. Also, each end 18/19 may be provides with a notch 25.

Ideally, each bracket used will be identical in design, i.e., shape and size. An exemplary bracket 30 is shown on the drawings. Bracket 30 is formed as a single piece. Broadly speaking, the components of this single piece include a plate 32, a support post receiving channel assembly 50, at least one hook 62, and at least one leg 70/72.

The plate 32 extends across and defines a first plane. Plate 32 has a first edge 34 extending from a first corner 36 to a second corner 38. The first edge 34 is divided into two portions 42 and 44 by a midpoint 40. The midpoint 40 may be at the exact center of the first edge or may be offset slightly from the exact center such that one portion is slightly longer than the other. Portion 42, referred to herein as the first arm attachment portion, is either equal in size or slightly longer than portion 44, referred to herein as the second arm attachment portion. The plate 32 also has a second edge 46 on the side of the plate 32 opposite the first edge 34, an outside planar surface 48, and an inside planar surface 49.

The support post receiving channel assembly 50 extends from the first edge 34. The support post receiving channel assembly 50 included a first arm 52, a second arm 54, and typically also includes a third arm 53. As shown, first arm 52 is flat and extends from the first arm attachment portion 42 of the first edge 34 of plate 32 along the same plane as the plate 32. The third arm 53 extends in a similar fashion from second arm attachment portion 44 of the first edge 34 of plate 32 along the same plane as the plate 32. The second arm 54 is shown as bent. The bent arm 54 has a first arm portion 58 extending from the second arm attachment portion 44 of the first edge 34 of the plate 32 between the first arm 52 and the third arm 53. The bent arm 54 extends from the first edge of the plate at a first angle 59. First angle 59 may be ninety degrees such that the first arm portion 58 extends in a direction normal to the plane along which the plate 32 extends. The bent arm 54 also has a second arm portion 60. Second arm portion 60 extends outwardly from the first arm portion 58 at a second angle 61. This second angle 61 may also be ninety degrees such that the second arm portion 60 extends in a direction normal to first arm portion 58 and parallel to the plane along which the plate 32 and flat arm 52 extend. Thus, the support post receiving channel assembly 50 forms a channel or space 56 which is adapted to receive a support post (4-7) of a scaffolding assembly 1 such that the support post is received between and engaged by the flat arms 52 and 53 and the second arm portion 60 of the bent arm 54. More specifically, the flat arms 52 and 53 extend along a first side of the support post and the second arm portion 60 of the bent arm 54 extends along a second side of a scaffolding support post when the post is within the channel 56 and toe board assembly 10 is in use.

The angles of the bent arm 54 may, of course, be altered without deviating from the invention. For example, the flat arm 52 and the second arm portion 60 of the bent arm 54 will still extend parallel to each other if the first angle 59 of the bent arm 54 is forty-five degrees and the second angle 61 of the bent arm 54 is one hundred thirty-five degrees. Further, it is not necessary that the flat arm 52 and second arm portion 60 of the bent arm 54 be parallel to each other, or that the bent arm 54 have two or more distinct angles. The bent arm could be curved as opposed to angled. Further, the first arm 52 could be bent or curved rather than flat.

It is important that the arms 52 and 54 of support post receiving channel assembly 50 of the brackets 30 be formed so that they can sufficiently capture a scaffolding post 4-7 to prevent inadvertent dislodgement of the bracket 30 from the post, while at the same time permitting the post to be easily coupled and decoupled from the bracket 30 when desired. Also important is that the arms 52 and 54 of the brackets 30 are designed so that two toe board assemblies 10 may be assembled ninety degrees from each other to the same scaffolding support post without the arms 52 and 54 of the bracket 30 of one such toe board assembly 10 interfering with the placement or operation of the bracket 30 of the other toe board assembly 10.

The bracket 30 also includes a hook 62 having a first hook portion 64 extending from the inside surface 49 of the plate 32 and a second hook portion 66 extending from the first hook portion 64 parallel to the plate 32. The gap between the second hook portion 66 and the plate 32 should be wide enough to permit an end 18/19 of the panel to be received within this gap. Further, the width of the first hook portion 64 should be such that this portion of the hook may be received within a notch 25 of the end 18/19 of the panel 14.

The bracket 30 further includes at least one leg extending from the second edge 46 of the plate. The number of legs will typically conform to the number of engagement slots adjacent each end of the toe board 12. Two such legs 70 and 71 and two such engagement slots (26 and 28 or 27 and 29) are shown in the drawings.

As shown, leg 70 includes a leg transition 72 and a foot 74. Likewise, leg 71 includes a leg transition 73 and a foot 75. The feet 74/75 are adapted, with respect to size and arrangement, to be inserted simultaneously through either slots 26 and 28 or slots 27 and 29. After such insertion, the transitions 72 and 73 reside within the slots. The transitions 72 and 73 are adapted to hold the feet 74/75 along a plane that this offset and parallel to the plane of the plate 32. The distance between these two planes is slightly greater than the thickness of the panel 14.

Given this construction of the brackets 30 and toe boards 12, a first bracket 30 is adapted to be coupled to a first end 18 of the panel 14 of the toe board 12 by passing the feet 74/75 of the legs 70/71 of a first bracket 30 through the engagement slots 26/28 adjacent the first end 18 of the panel 14 so that the feet 74/75 of the legs 70/71 engage the inside surface 16 of the panel 14, the transitions 72/73 of the legs 70/71 reside within the engagement slots 26/28, the plate 32 engages the outside surface 17 of the panel 14, and the hook 62 engages the first end 18 of the panel 14. Likewise, a second bracket 30 may be coupled to the second end 19 of the toe board panel 14 by passing the feet 74/75 of the legs 70/71 of a second bracket 30 through the engagement slots 27/28 adjacent the second end 19 of the panel 14 so that the feet 74/75 of the legs 70/71 engage the inside surface 16 of the panel 14, the transitions 72/73 of the legs 70/71 reside within the engagement slots 27/29, the plate 32 of the second bracket 30 engages the outside surface 17 of the panel 14, and the hook 62 of the second bracket 30 engages the second end 19 of the panel 14.

When the brackets 30 are coupled to the toe board 12 as described above, the holes 15 extending through the toe board are aligned with holes 80 extending through the brackets 30. For additional security and to prevent inadvertent detachment of the brackets 30 from the toe board 12, the threaded shafts of bolts (not shown) may be inserted through the aligned holes 15 and 80. A nut can then be fastened to each such bolt. Washers may also be used.

Once the two brackets are so attached, the support post receiving channel assemblies 50 of the two brackets 30 may be coupled to adjacent posts (e.g., 4 and 5) of the scaffolding assembly 1 and the assembly of the toe board 12 and two brackets 30 may be slid into position so that the bottom of the panel 14 comprising the bottom lip 24 rests on top of a scaffolding platform 2 with the panel 14 extending in an upward and perpendicular direction from the top surface 3 of the platform 2. A second pair of brackets 30 can be coupled to a second toe board as described above, and then this assembly may also be coupled to support posts 5 and 6. This process is repeated until the platform 2 is sufficiently surrounded to prevent overstepping and items from sliding or rolling off the platform 2. This may require a single toe board assembly 10 if the scaffolding is surrounded on three sides by some other building structure, a pair of toe board assemblies 10 if the scaffolding is surrounded on two sides by walls of a building, or three toe board assemblies 10 if the scaffolding is positioned immediately adjacent a single flat wall of a building. In many cases, four such assemblies will be required to offer protection along all four sides of the platform 2.

The present invention permits two toe board assemblies 10 to be easily coupled to the same post without the two support posts receiving channel assemblies 50 of the two toe board assemblies 10 interfering with each other. This is because bent arm 52 of a bracket 30 is toward the top when a bracket 30 is coupled to the first end 18 of the panel 14, and because bent arm 52 of a bracket 30 is toward the bottom when a bracket 30 is coupled to the second end 19 of the panel 14.

The toe boards 12 may be fabricated out of any suitable metallic or plastic material. When made of a plastic material, such as such as polyethylene or polyvinyl chloride, they may be extruded, or injection molded. When extruded, they may be cut to length and further cut to remove the material necessary to form the engagement slots. When made of a metallic material such as aluminum or steel, the toe boards can be cut or stamped to form a blank of the correct size. The blank can then be bent to form the panel 14, the top lip 21, and the bottom lip 24. The blank is also cut to form the engagement slots and notches 25, and then drilled to form the holes 15.

The brackets 30 may be formed using an injection molding process when made of a plastic such as polyethylene or polyvinyl chloride. An appropriate mold is used to form all the necessary components of the bracket as a single piece. When made of a metallic material, such as aluminum or steel, a generally H-shaped blank is formed by cutting or stamping. The crossbar of the H-shape serves as the plate 32, the portions of the side bars of the H-shaped blank below the crossbar are formed into the legs 70/71, and the portions of the side bars of the H-shaped blank above the crossbar serve as the arms 52, 53 and 54. The legs 70/71 are bent to form the transitions 72/73 and the feet 74/75. Likewise, the second arm 54 is bent to place the first arm portion 58 at the first angle 59 relative to the plate 32, and bent again to place the second arm portion 60 at the second angle 61 relative to the first arm portion 58. Alternatively, the second arm may be formed into a curve rather than angled. To create the hook 62, a three-sided cut is made in the plate 32, and the separate piece formed in the plate 32 by this cut is bent to form the first hook portion 64 and bent again to form the second hook portion 66. The hook may be bent to form its shape as described above, either during initial manufacture of the bracket 30 or as the bracket is being coupled to the panel 14. Also, when nuts and bolts are employed as described above, the hook 62 may extend through the notch 25 and only perpendicularly to the plane of the plate with the first and second hook portions 64 and 66 extending along the same plane rather than at a ninety degree angle relative to each other. Therefore, some of the drawings show the hook as flat rather than bent.

Within the scope of the following claims, the invention may be practiced otherwise than as specifically shown in the drawings and described above. The foregoing description is intended to explain the various features and advantages but is not intended to be limiting. The scope of the invention is defined by the following claims which are also intended to cover a reasonable range of equivalents.

What is claimed is:

1. A scaffolding toe board assembly comprising:

(a) a toe board having a planar panel with an inside surface, an outside surface, a first end, a second end, and a first engagement slot extending through the planar panel adjacent the first end of the planar panel; and (b) a first bracket adapted to temporarily couple the toe board to a support post of a scaffolding assembly, said first bracket formed as a single piece and comprising:

(i) a plate extending along a first plane, said plate having a first edge and a second edge parallel to the first edge, said first edge having a first corner, a second corner, a midpoint, a first arm attachment portion extending from the first corner to the midpoint, and a second arm attachment portion extending from the midpoint to the second corner;

(ii) a support post receiving channel assembly extending outwardly from the first edge, said support post receiving channel assembly comprising a first arm extending from the first arm attachment portion and a second arm extending from the second arm attachment portion, said support post receiving channel assembly adapted to receive and engage the support post of the scaffolding assembly between the first arm and the second arm;

(iii) a hook adapted to receive and engage the first end of the planar panel, wherein the hook has a first hook portion extending downwardly from an inside surface of the plate and a second hook portion spaced from and extending from the first portion parallel to the inside surface of the plate; and (iv) a first leg extending from the second edge, said first leg comprising a first transition and a first foot extending from the first transition along a second plane parallel to the first plane, said first foot adapted to pass through the engagement slot and said transition adapted to reside within the engagement slot; and wherein the support post receiving channel assembly comprises a third arm which is flat and extends outwardly along the first plane, and wherein said second arm extends from the first edge of the plate between said first arm and said third arm.

2. The scaffolding toe board assembly of claim 1 wherein, said first bracket is adapted to be coupled to the toe board by passing the first foot of the first leg through the first engagement slot so that the first foot of the first leg engages the inside surface of the planar panel, the first transition of the first leg resides within the first engagement slot, the plate engages the outside surface of the planar panel, and the hook engages the first end.

3. The scaffolding toe board assembly of claim 1 wherein a second engagement slot extends through the planar panel adjacent the first end of the planar panel.

4. The scaffolding toe board assembly of claim 3 wherein the first bracket has a second leg extending from the second edge, said second leg comprising a second transition and a second foot extending from the second transition along a second plane parallel to the first plane, said second foot adapted to pass through the second engagement slot and said second transition adapted to reside within the second engagement slot.

5. The scaffolding toe board assembly of claim 4 wherein said first bracket is adapted to be coupled to the toe board by also passing the first foot of the first leg through the first engagement slot and the second foot of the second leg through the second engagement slot so that the first foot and the second foot each engage the inside surface of the planar panel, the first transition of the first leg resides within the first engagement slot, the second transition of the second leg resides within the second engagement slot, the plate engages the outside surface of the planar panel, and the hook engages the first end.

6. The scaffolding toe board assembly of claim 4 further comprising third and fourth engagement slots extending through the planar panel adjacent a second end of the planar panel, and a second bracket having the same construction as the first bracket adapted to temporarily couple the toe board to a second support post of the scaffolding assembly.

7. The scaffolding toe board assembly of claim 1 further comprising a third engagement slot extending through the planar panel adjacent a second end of the planar panel, and a second bracket having the same construction as the first bracket adapted to temporarily couple the toe board to a second support post of the scaffolding assembly.

8. The scaffolding toe board assembly of claim 1 wherein said toe board has a support lip projecting from a bottom edge of the planar panel.

9. The scaffolding toe board assembly of claim 1 wherein said first bracket is made of a single piece of metal material.

10. The scaffolding toe board assembly of claim 1 wherein the first bracket is a single piece of plastic material.

11. A scaffolding toe board assembly comprising:

(a) a toe board having a planar panel with an inside surface, an outside surface, a first end, a second end, and a first engagement slot extending through the planar panel adjacent the first end of the planar panel; and (b) a first bracket adapted to temporarily couple the toe board to a support post of a scaffolding assembly, said first bracket formed as a single piece and comprising:

(i) a plate extending along a first plane, said plate having a first edge and a second edge parallel to the first edge, said first edge having a first corner, a second corner, a midpoint, a first arm attachment portion extending from the first corner to the midpoint, and second arm attachment portion extending from the midpoint to the second corner;

(ii) a support post receiving channel assembly extending outwardly from the first edge, said support post receiving channel assembly comprising a first arm extending from the first arm attachment portion and a second arm extending from the second arm attachment portion, said support post receiving channel assembly adapted to receive and engage the support post of the scaffolding assembly between the first arm and the second arm, wherein the first arm of the support post receiving channel assembly is flat and extends outwardly along the first plane, and the second arm of the support post receiving channel assembly is bent having a first arm portion extending from the second arm attachment portion at a first angle and a second arm portion extending outwardly from the first arm portion at a second angle such that the second arm portion is spaced from and extends parallel to the first arm;

(iii) a hook adapted to receive and engage the first end of the planar panel; and (iv) a first leg extending from the second edge, said first leg comprising a first transition and a first foot extending from the first transition along a second plane parallel to the first plane, said first foot adapted to pass through the engagement slot and said transition adapted to reside within the engagement slot.

12. A scaffolding toe board assembly comprising:

(a) a toe board having a planar panel with an inside surface, an outside surface, a first end, a second end, and first and second engagement slots extending through the planar panel adjacent the first end of the planar panel; and (b) a first bracket adapted to temporarily couple the toe board to a support post of a scaffolding assembly, said first bracket formed as a single piece and comprising:

(i) a plate extending along a first plane, said plate having a first edge and a second edge parallel to the first edge, said first edge having a first corner, a second corner, a midpoint, a first arm attachment portion extending from the first corner to the midpoint, and second arm attachment portion extending from the midpoint to the second corner;

(ii) a support post receiving channel assembly extending outwardly from the first edge, said support post receiving channel assembly comprising a first arm extending from the first arm attachment portion, a second arm extending from the second arm attachment portion, and a third arm extending from the second arm attachment portion, said support post receiving channel assembly adapted to receive and engage a support post of the scaffolding assembly in a space defined on one side by the first arm and the third arm and on an opposing side by the second arm;

(iii) a hook adapted to receive and engage the first end of the planar panel;

(iv) a first leg extending from the second edge, said first leg comprising a first transition and a first foot extending from the first transition along a second plane parallel to the first plane, said first foot adapted to pass through the engagement slot and said transition adapted to reside within the engagement slot; and (v) a second leg extending from the second edge, said second leg comprising a second transition and a second foot extending from the second transition along a second plane parallel to the first plane, said second foot adapted to pass through the second engagement slot and said second transition adapted to reside within the second engagement slot.

13. The scaffolding toe board assembly of claim 12 wherein said first bracket is adapted to be coupled to the toe board by passing the first foot of the first leg through the first engagement slot and the second foot of the second leg through the second engagement slot so that the first foot and the second foot each engage the inside surface of the planar panel, the first transition of the first leg resides within the first engagement slot, the second transition of the second leg resides within the second engagement slot, the plate engages the outside surface of the planar panel, and the hook engages the first end.

14. The scaffolding toe board assembly of claim 12 further comprising third and fourth engagement slots extending through the planar panel adjacent a second end of the planar panel, and a second bracket having the same construction as the first bracket and adapted to temporarily couple the toe board to a second support post of the scaffolding assembly.

15. The scaffolding toe board assembly of claim 12 wherein said hook has a first portion extending from an inside surface of the plate and a second portion spaced from and extending from the first portion parallel to the inside surface of the plate.

16. The scaffolding toe board assembly of claim 12 wherein the first arm and third arm of the support post receiving channel assembly are flat and extend outwardly along the first plane, and the second arm of the support post receiving channel assembly is bent having a first arm portion extending from the second arm attachment portion at a first angle and a second arm portion extending outwardly from the first arm portion at a second angle such that the second arm portion is spaced from and extends parallel to the first arm and the third arm.

17. The scaffolding toe board assembly of claim 12 wherein said toe board has a reinforcing lip projecting from a top edge of the planar panel.

18. The scaffolding toe board assembly of claim 12 wherein said toe board has a support lip projecting from a bottom edge of the planar panel.

* * * * *